US009533421B2

(12) United States Patent
Shimizu

(10) Patent No.: US 9,533,421 B2
(45) Date of Patent: Jan. 3, 2017

(54) RECIPROCATING-TYPE ELECTRIC SHAVER

(71) Applicant: Izumi Products Company, Matsumoto-shi, Nagano (JP)

(72) Inventor: Tetsuhiko Shimizu, Matsumoto (JP)

(73) Assignee: IZUMI PRODUCTS COMPANY, Nagano (JP)

( * ) Notice: Subject to any disclaimer, the term of this patent is extended or adjusted under 35 U.S.C. 154(b) by 165 days.

(21) Appl. No.: 14/556,388

(22) Filed: Dec. 1, 2014

(65) Prior Publication Data

US 2015/0165630 A1 Jun. 18, 2015

(30) Foreign Application Priority Data

Dec. 16, 2013 (JP) ..... 2013-259618

(51) Int. Cl.
*B26B 19/04* (2006.01)

(52) U.S. Cl.
CPC ..... *B26B 19/046* (2013.01); *B26B 19/044* (2013.01)

(58) Field of Classification Search
CPC ..... B26B 19/044; B26B 19/046; B26B 19/02; B26B 19/04; B26B 19/06; B26B 19/063; B26B 19/10; B26B 19/102
See application file for complete search history.

(56) References Cited

U.S. PATENT DOCUMENTS

2007/0245565 A1* 10/2007 Sato ..... B26B 19/04 30/43.92

FOREIGN PATENT DOCUMENTS

JP 4224132 B1 2/2009
JP 4650871 B2 3/2011

* cited by examiner

*Primary Examiner* — Jonathan Riley
*Assistant Examiner* — Liang Dong
(74) *Attorney, Agent, or Firm* — Birch, Stewart, Kolasch & Birch, LLP

(57) ABSTRACT

In a reciprocating-type electric shaver, an inner blade has an attachment groove which is open downward in a lower end of a side edge. An inner peripheral portion of the attachment groove has an engagement groove which is recessed in an in-plane direction on a wall surface of the side edge and in a longitudinal direction of the inner blade. An inner blade base has a projection at a position corresponding to the attachment groove. The projection can be elastically deformed in the in-plane direction on the wall surface of the side edge and in the longitudinal direction of the inner blade, and is formed so that an engagement claw disposed in a distal end of the projection can enter and engage with the engagement groove. The engagement claw engages with the engagement groove, thereby causing the inner blade to be fixed to the inner blade base.

16 Claims, 5 Drawing Sheets

RECIPROCATING-TYPE ELECTRIC SHAVER

CROSS-REFERENCE TO RELATED APPLICATION

This application is based upon and claims the benefit of priority of the prior Japanese Patent Application No. P2013-259618, filed on Dec. 16, 2013, and the entire contents of which are incorporated herein by reference.

FIELD

The present invention relates to a reciprocating-type electric shaver.

BACKGROUND

For example, as disclosed in PTLs 1 and 2, a reciprocating-type electric shaver is known in which an inner blade supported by an inner blade base and having an inverted U-shape in a cross-sectional view slides and reciprocates on an inner surface of an outer blade.

CITATION LIST

Patent Literature

PTL 1: Japanese Patent No. 4650871
PTL 2: Japanese Patent No. 4224132

SUMMARY

Technical Problem

Here, in the reciprocating-type electric shaver disclosed as an example in PTL 1, when an inner blade unit is formed by fixing a metallic inner blade to an inner blade base, an engagement claw disposed in the inner blade is folded with respect to a retaining recess disposed in the inner blade base, thereby forming the inner blade unit. Therefore, it is necessary to perform a process for folding the engagement claw. Consequently, there is a problem of an increased number of processes, decreased production efficiency, and increased production costs.

In contrast, the reciprocating-type electric shaver disclosed as an example in PTL 2 has no configuration in which the engagement claw disposed in the inner blade is folded with respect to the retaining recess disposed in the inner blade base. Alternatively, a configuration is adopted in which a supplementary claw disposed in the inner blade base engages with a mounting hole disposed in the inner blade in a snap-fit manner during assembly work. Therefore, an advantageous effect can be obtained in that the number of processes does not increase. Here, in the configuration disclosed as an example in PTL 2, when the inner blade is assembled to the inner blade base, the supplementary claw is deformed inward in a short direction by an oblique guide surface disposed in an upper portion of the supplementary claw. If the assembly is completed, the supplementary claw is restored outward. However, an end surface of a lower end portion of the inner blade has a sharp edge shape. Consequently, an edge portion thereof encroaches on the oblique guide surface of the supplementary claw, thereby causing a problem in that the claw is not deformed and the assembly work cannot be carried out.

The present invention is made in view of the above-described circumstances, and an object thereof is to provide a reciprocating-type electric shaver in which an inner blade can be assembled to an inner blade base with a further decreased number of processes so that production efficiency can be improved and production costs can be decreased, and which can ensure reliable assembly work by preventing a possibility that the assembly work cannot be carried out since the inner blade encroaches on the inner blade base during the assembly work.

Solution to Problem

As one embodiment, means for solving the above-described problems is disclosed as follows.

In a reciprocating-type electric shaver in which an inner blade supported by an inner blade base and having an inverted U-shape in a cross-sectional view slides and reciprocates on an inner surface of an outer blade, the inner blade has an attachment groove which is open downward in a lower end of a side edge. An inner peripheral portion of the attachment groove has an engagement groove which is recessed in an in-plane direction on a wall surface of the side edge and in a longitudinal direction of the inner blade. The inner blade base has a projection at a position corresponding to the attachment groove of the inner blade. The projection can be elastically deformed in the in-plane direction on the wall surface of the side edge and in the longitudinal direction of the inner blade, and is formed so that an engagement claw disposed in a distal end of the projection can enter and engage with the engagement groove. The engagement claw engages with the engagement groove, thereby causing the inner blade to be fixed to the inner blade base.

Advantageous Effects

According to the disclosed reciprocating-type electric shaver, it is unnecessary to perform a folding process of an inner blade during assembly work. The inner blade can be assembled to an inner blade base with a further decreased number of processes so that production efficiency can be improved and production costs can be decreased. Furthermore, it is possible to prevent a possibility that the assembly work cannot be carried out since the inner blade encroaches on the inner blade base during the assembly work. Therefore, the assembly work can be reliably carried out. It is possible to prevent a defective product and downtime in a production process.

DESCRIPTION OF THE EMBODIMENTS

Figure 1:
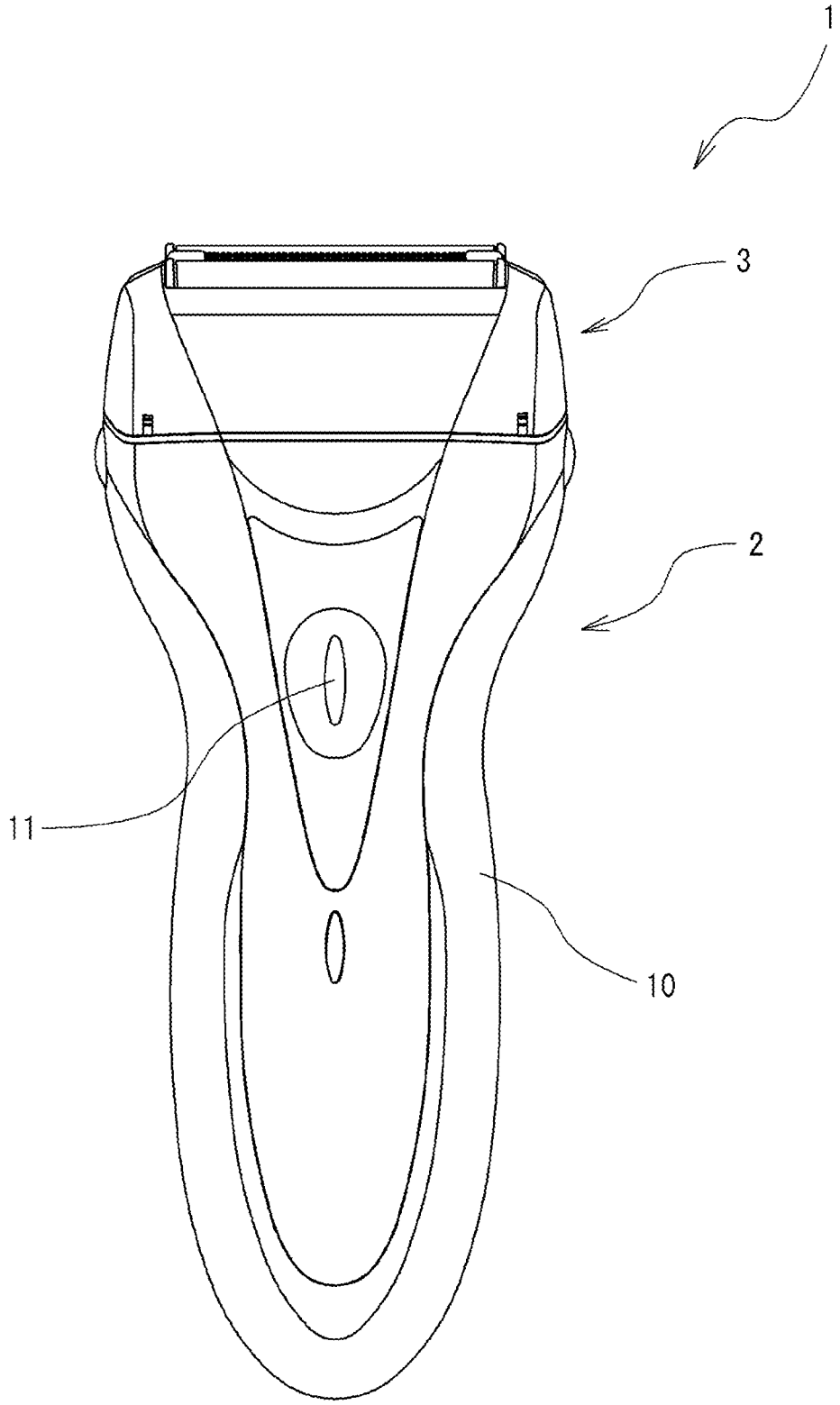
FIG. 1 is a schematic view illustrating an example of a reciprocating-type electric shaver according to an embodiment of the present invention.
Figure 2:
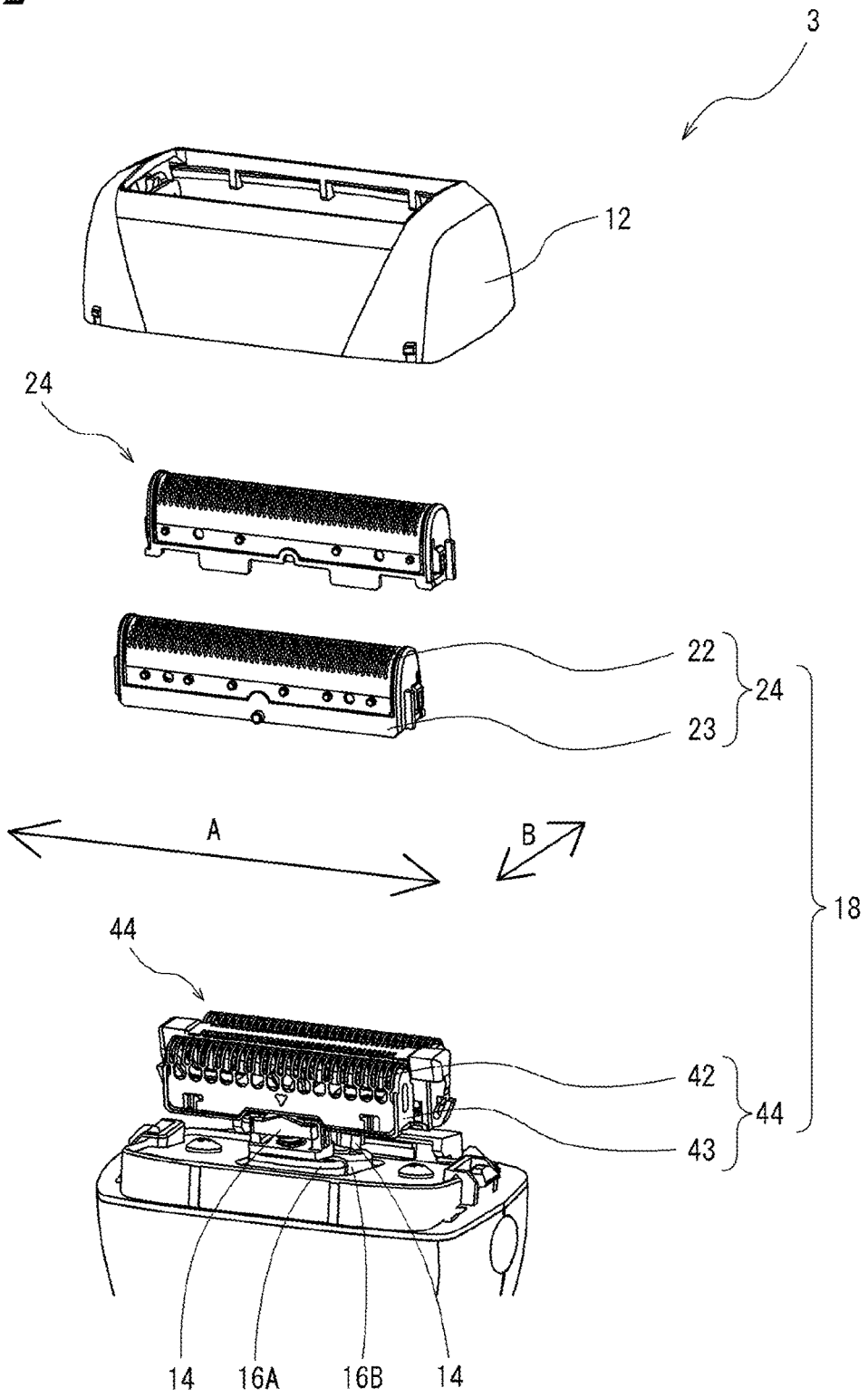
FIG. 2 is a schematic view (exploded view) illustrating an example of a head unit of the reciprocating-type electric shaver illustrated in FIG. 1.

Hereinafter, a first embodiment of the present invention will be described in detail with reference to the drawings. FIG. 1 is a schematic view (perspective view) illustrating an example of a reciprocating-type electric shaver 1 according to the present embodiment. In addition, FIG. 2 is a schematic view (exploded perspective view) illustrating an example of a head unit 3 of the reciprocating-type electric shaver 1. In all the drawings for describing embodiments, the same reference numerals are given to members having the same function, and in some cases, repeated description thereof will be omitted.

As illustrated in FIGS. 1 and 2, the reciprocating-type electric shaver 1 of the embodiment is configured to include an outer blade 22 having many hair-entry apertures, and an inner blade 42 which slides and reciprocates on a lower surface of the outer blade 22, and is a reciprocating-type electric shaver which cuts hairs entering the hair-entry apertures by using the outer blade 22 and the inner blade 42. In this invention, examples of the hairs include beards, mustache, whisker, and the like. An example of the reciprocating-type electric shaver having two sets of a combination of the outer blade 22 and the inner blade 42 will be described, but the present embodiment is not limited thereto.

In FIG. 1, the reference numeral 2 is a main body, and includes a substantially cylindrical case 10. A motor for causing the inner blade 42 to reciprocate, a battery serving as a power source of the motor, and a control circuit board for controlling the drive of the motor (all not illustrated) are accommodated inside the case 10. In addition, a power switch 11 is attached to a front surface of the case 10.

In addition, an eccentric pin (not illustrated) which transmits a driving force for causing the inner blade 42 to reciprocate protrudes from an upper surface of the case 10 in a direction toward a head unit 3 (to be described later), and engages with vibrators 16A and 16B (to be described later).

In contrast, in FIGS. 1 and 2, the reference numeral 3 is the head unit. As a characteristic configuration in the present embodiment, the head unit 3 is held by the main body 2 so as to be tiltable. A method in which the head unit 3 is held by the main body 2 may be a method of fixing the head unit 3 so as not to be tiltable.

As illustrated in FIG. 2, a head cover 12 connected to an upper portion of the case 10 of the main body 2 is disposed in the head unit 3. An outer blade unit 24 is attached to the head cover 12 from below via an outer blade case (not illustrated). In contrast, an inner blade unit 44, and a drive mechanism (not illustrated) including a gear (not illustrated) for driving the inner blade unit 44, an inner blade drive shaft, and the like are arranged inside the head cover 12. Here, the outer blade unit 24 is configured so that the outer blade 22 is fixed to an outer blade base 23, and the inner blade unit 44 is configured so that the inner blade 42 is fixed to an inner blade base 43. As described above, in the present embodiment, a case will be described which includes two sets of a combination (that is, blade unit 18) of the outer blade unit 24 and the inner blade unit 44. However, a basic configuration may be similarly conceivable even in a case where the number of the combination sets is not two.

The outer blade 22 according to the present embodiment adopts a configuration in which a metal plate made of stainless steel and having a predetermined thickness is fixed to the outer blade base 23 by being bent in an arch shape, that is, in an inverted U-shape in a cross-sectional view taken on a plane perpendicular to a longitudinal direction A. Many openings (hair-entry apertures) for introducing hairs penetrate the metal plate, and are formed in an arch-shaped bent portion (that is, a predetermined top portion and a peripheral portion thereof) of the outer blade 22. This enables the hairs entering the hair-entry apertures to be cut by being interposed between a lower surface (inner surface) of the outer blade 22 and the inner blade 42. The hair-entry apertures can employ various shapes such as a round hole shape, a slit shape, or a combined shape thereof.

In contrast, although the inner blade 42 will be described in detail later, the inner blade 42 adopts a configuration in which a metal plate made of stainless steel and having a predetermined thickness is fixed to the inner blade base 43 by being bent in an arch shape, that is, in an inverted U-shape in a cross-sectional view taken on a plane perpendicular to the longitudinal direction A. As illustrated in FIG. 2, many small blades 46 (refer to FIG. 3) having an arch shape are integrally formed in the inner blade 42. An arch-shaped upper surface (outer peripheral surface) of the inner blade 42, that is, the respective small blades 46, has a curved surface which comes into sliding contact with an inner surface of the outer blade 22.

The above-described inner blade base 43 is held by a holding member 14 so as to be swingable and vertically movable. The present embodiment adopts a configuration in which two sets of the outer blades 22 and 22 are held to be parallel to each other by the outer blade bases 23 and 23, and a configuration in which two sets of the inner blades 42 and 42, the inner blade bases 43 and 43, and the holding members 14 and 14 are disposed corresponding to the outer blades 22 and 22.

Here, as illustrated in FIG. 2, the vibrators 16A and 16B are disposed in an upper portion of the main body 2. More specifically, the vibrators 16A and 16B are configured to be held by the main body 2 and to be swingable in a reciprocating direction of the inner blades 42 and 42. In addition, an eccentric pin (not illustrated) fixed to a rotary shaft of the motor engages with the vibrators 16A and 16B. This configuration causes the vibrators 16A and 16B to reciprocate with a mutual phase difference of 180°. Therefore, the holding members 14 and 14 fixed to the vibrators 16A and 16B also reciprocate. Accordingly, it is possible to obtain an operation in which two sets of the inner blades 42 and 42 reciprocate with the mutual phase difference of 180°.

The outer blade 22 fixed to the outer blade base 23 is held so as to be sinkable downward by an outer blade case (not illustrated). In contrast, the inner blade 42 fixed to the inner blade base 43 is held and pressed upward by the holding member 14. This configuration can provide an operation in which the inner blade 42 slides and reciprocates on the inner surface of the outer blade 22.

Figure 3:
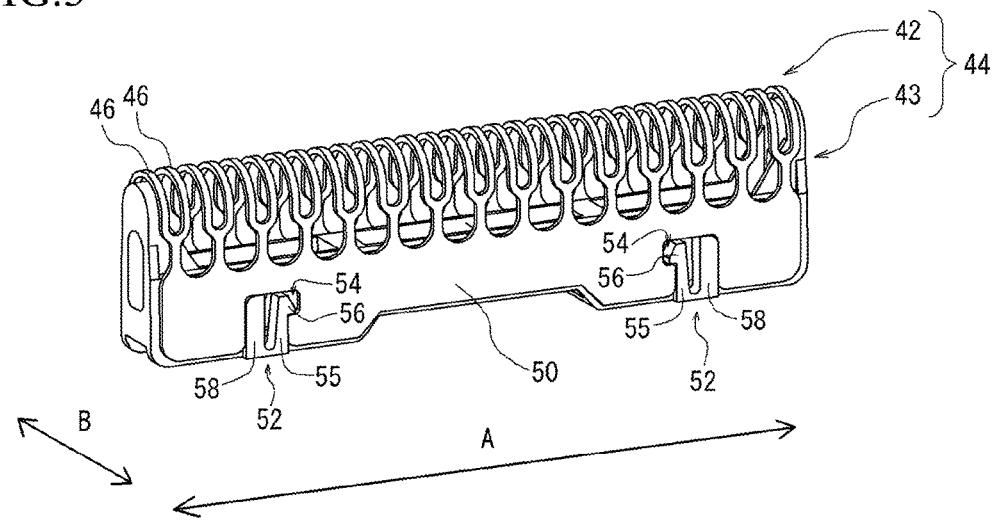
FIG. 3 is a schematic view (perspective view) illustrating an example of an inner blade unit of the reciprocating-type electric shaver illustrated in FIG. 1.
Figure 4:
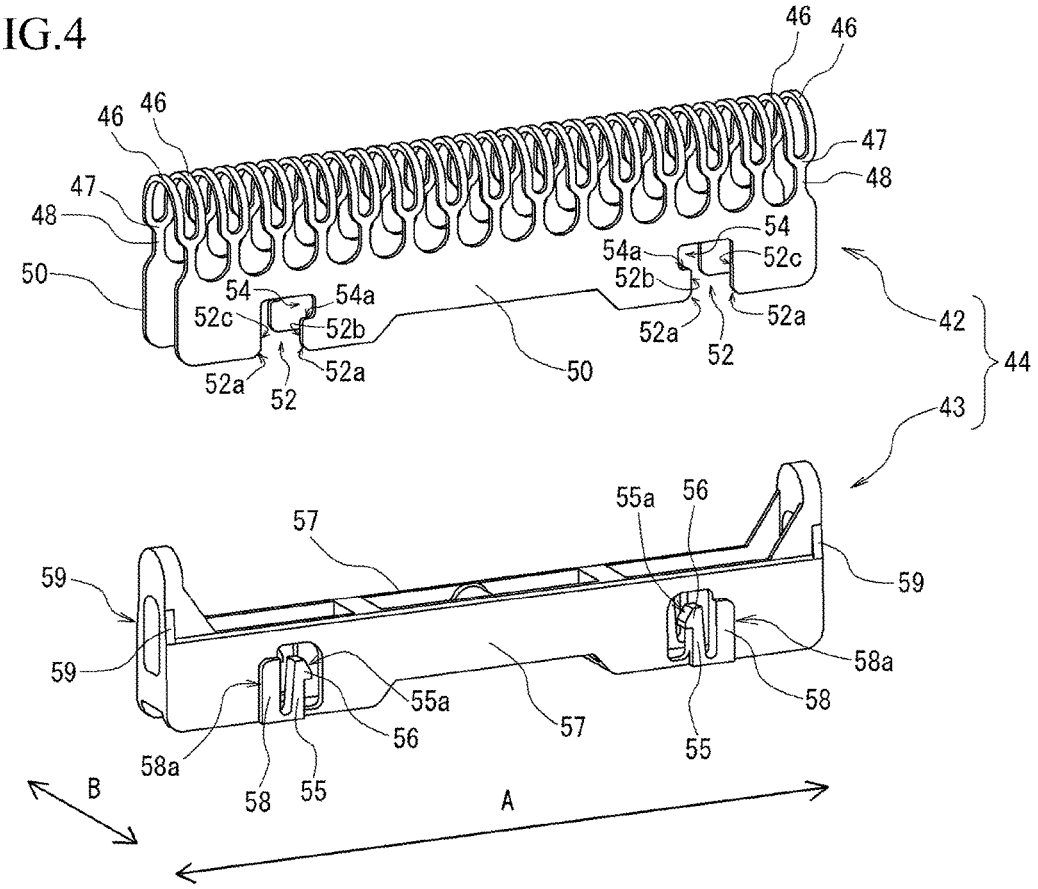
FIG. 4 is a schematic view (perspective view) illustrating an example of an inner blade and an inner blade base of the reciprocating-type electric shaver illustrated in FIG. 1.
Figure 5:
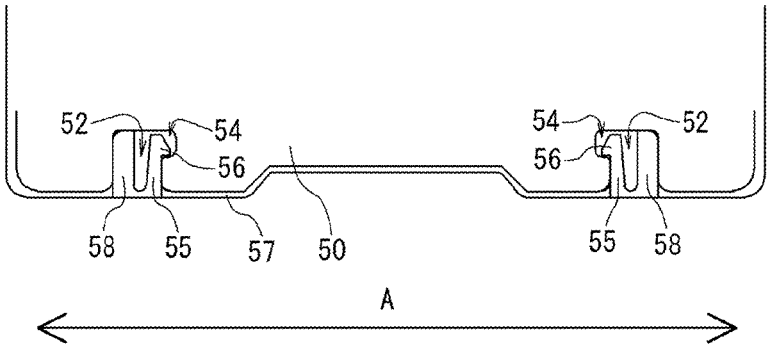
FIG. 5 is a schematic view (front view) illustrating an example of the inner blade unit of the reciprocating-type electric shaver illustrated in FIG. 1.
Figure 6:
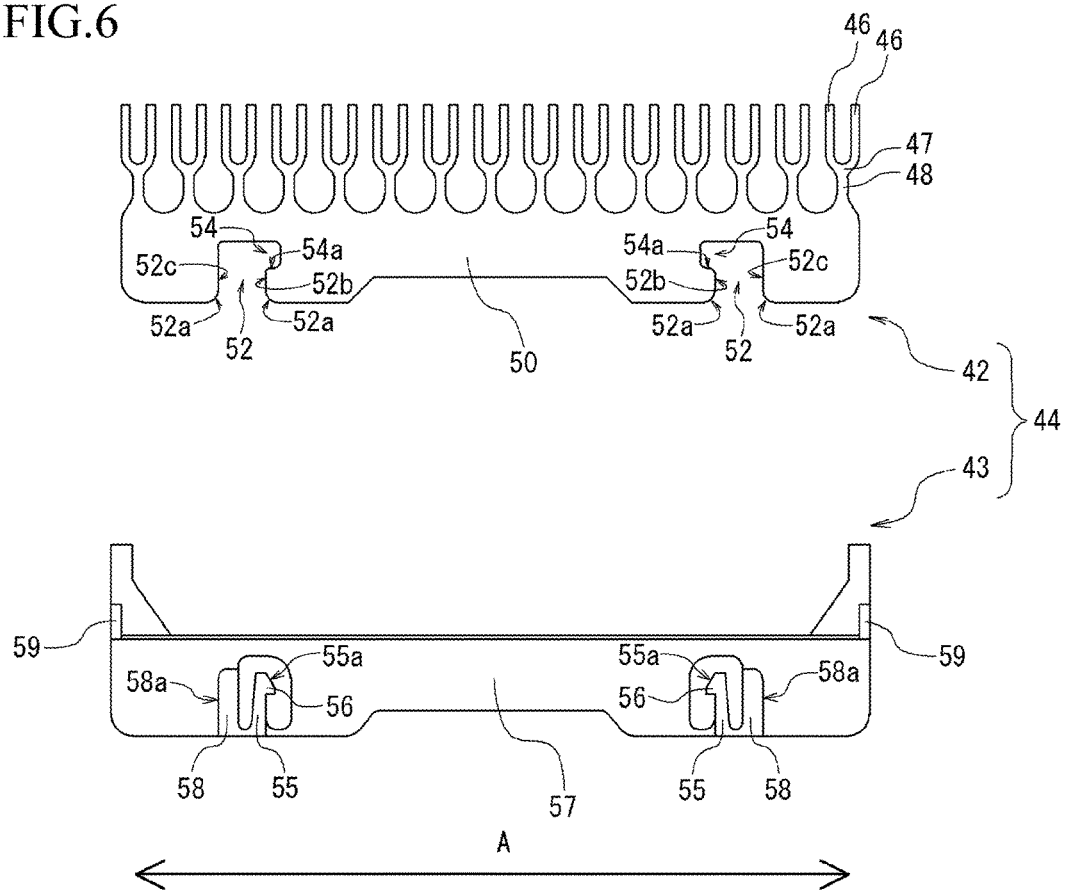
FIG. 6 is a schematic view (front view) illustrating an example of the inner blade and the inner blade base of the reciprocating-type electric shaver illustrated in FIG. 1.
Figure 7A:
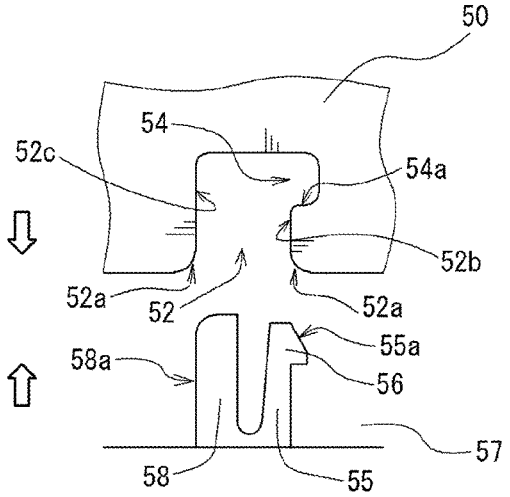
FIGS. 7A to 7D are views for describing an assembly process between the inner blade and the inner blade base in the reciprocating-type electric shaver illustrated in FIG. 1.
Figure 7B:
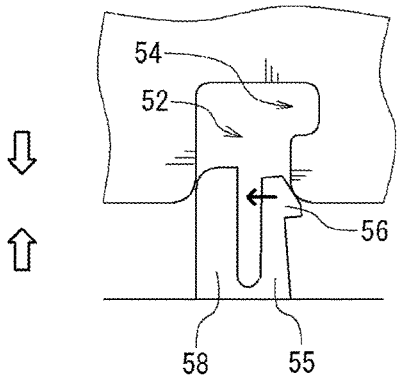
Figure 7C:
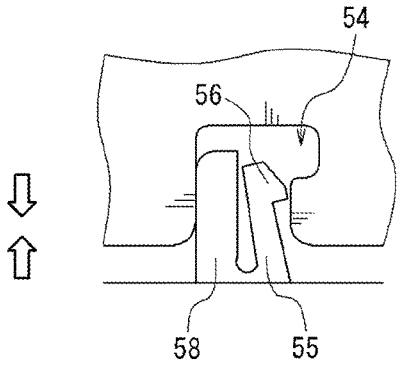
Figure 7D:
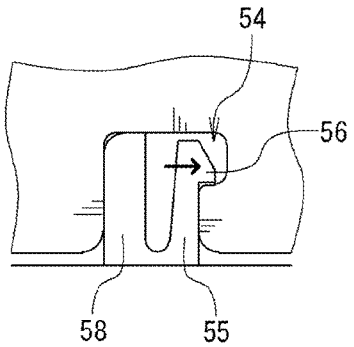

Next, a characteristic configuration of the inner blade 42 in the present embodiment will be described in detail. FIG. 3 illustrates a schematic perspective view of the configuration of the inner blade unit 44 in which the inner blade 42 is fixed to the inner blade base 43, and FIG. 5 illustrates a schematic front view thereof. In addition, FIG. 4 illustrates an exploded perspective view of a state where the respective members are separated from each other, and FIG. 6 illustrates an exploded front view thereof.

As illustrated in FIGS. 3 to 6, the inner blade 42 includes a configuration in which a metal plate made of stainless steel formed to have a predetermined shape and having a thickness of approximately 0.3 mm is bent in an arch shape, that is, in an inverted U-shape in a cross-sectional view taken on a plane perpendicular to the longitudinal direction A. Many small blades 46 are integrally formed in the metal plate by using a suitable processing method such as etching work or press work.

The small blades 46 are arrayed to be orthogonal to a reciprocating direction (direction of arrow A in each drawing) of the inner blade 42, and are arrayed side by side at a predetermined pitch in the reciprocating direction. As an example, both ends of the two adjacent small blades 46 and 46 have a shape in which both ends are connected to each other in merging portions 47 and 47. The merging portions 47 and 47 are respectively connected to side edges 50 and 50 disposed on both sides by connecting portions 48 and 48.

Here, in the inner blade 42, an attachment groove 52 which is open downward is formed in a lower end of the side edge 50. In the present embodiment, as an example, the attachment groove 52 is disposed at two locations in each of the two (on both sides) side edges 50 and 50 (refer to FIGS. 3 to 6).

In addition, an inner peripheral portion of the attachment groove 52 has an engagement groove 54 which is recessed (that is, cut out) in an in-plane direction on a wall surface of the side edge 50 and in a longitudinal direction (direction A in the drawing) of the inner blade 42. In the present embodiment, as an example, the attachment groove 52 is formed in an inverted L-shape in a front view, which has a stepped portion 54*a* for enabling an engagement claw 56 (to be described later) to be engaged therewith. In addition, two engagement grooves 54 disposed in two attachment grooves 52 in one side edge 50 are formed to face inward mutually. As will be described later, as a modification example, the two engagement grooves 54 may be configured to face outward mutually.

In contrast, in the inner blade base 43 to which the inner blade 42 is fixed, a projection 55 having a shape which can enter the attachment groove 52 is formed at a position corresponding to the attachment groove 52 of the inner blade 42. More specifically, the projection 55 and the attachment groove 52 are formed so that positions in the longitudinal direction (direction A) are coincident with each other and positions in a short direction (direction B) are coincident with each other (refer to FIGS. 3 and 5).

Here, in a state where the inner blade 42 is fixed to the inner blade base 43, a width in the short direction (direction B) of the inner blade base 43 (width between side walls 57) is set to be coincident with a width (width between the side edges 50) in the short direction (direction B) of the inner blade 42. Therefore, the projection 55 of the inner blade base 43 is disposed at a position protruding outward in the short direction (direction B) from the side wall 57 of the inner blade base 43 (refer to FIG. 4). This configuration enables the projection 55 to be coincident with the attachment groove 52 of the inner blade 42 in the short direction (direction B). As an example, a material for forming the inner blade base 43 employs a synthetic resin which has predetermined strength and enables a predetermined portion (here, the projection 55) to be elastically deformed.

Furthermore, the projection 55 can be elastically deformed in the in-plane direction on the wall surface of the side edge 50 (that is, the in-plane direction on the wall surface of the side wall 57) and in the longitudinal direction (direction A) of the inner blade 42 (inner blade base 43), and the engagement claw 56 disposed in a distal end of the projection 55 is formed so as to enter and engage with the engagement groove 54 disposed in the attachment groove 52 of the inner blade 42. Here, FIGS. 7A to 7D sequentially illustrate a state where the projection 55 enters the inside of the attachment groove 52 while being elastically deformed and the engagement claw 56 of the distal end enters and engages with the engagement groove 54.

Since the projection 55 is configured to be elastically deformable, when the inner blade 42 is assembled to the inner blade base 43, an advantageous effect can also be obtained in that a dimensional error is absorbed in the longitudinal direction (direction A) of an attachment portion (that is, the attachment groove 52 and the projection 55).

In addition, in the present embodiment, the projection 55 is formed in a shape where a lower end portion thereof is fixed to the side wall 57 and the projection 55 protrudes upward (refer to FIGS. 4 and 6). According to this configuration, it is possible to realize a configuration which allows a simple fixing structure of the projection 55, and which can easily withstand a downward acting force received from the inner blade 42 during assembly work. In addition, this configuration does not cause deformation and rotational moment in the short direction (direction B) during the assembly work. Therefore, a small load is applied to the projection 55. It is possible to prevent breakage from occurring. The projection 55 is formed integrally with the inner blade base 43, but may be configured to be formed separately. In addition, a modification example is also conceivable in which the projection 55 has a shape of hanging downward.

As described above, the engagement claw 56 engages with the engagement groove 54, thereby bringing the inner blade 42 in a state of being fixed to the inner blade base 43. According to a configuration of the inner blade 42 and the inner blade base 43 in the present embodiment, it is unnecessary to provide a process of folding the engagement claw disposed in the inner blade with respect to the retaining recess disposed in the inner blade base, unlike the configuration disclosed as an example in PTL 1 in the related art. The inner blade can be assembled to the inner blade base with a further decreased number of processes. As a result, production efficiency can be improved and production costs can be decreased.

Furthermore, in the present embodiment, the width (width between side edges 50) in the short direction (direction B) of the inner blade 42 is formed to be narrower than the width (width between the side walls 57) in the short direction (direction B) of the inner blade base 43 by a minute length (for example, approximately 0.5 mm). In a state where the assembly work is carried out, the inner surface of the side edge 50 of the inner blade 42 comes into close contact with the outer surface of the side wall 57 of the inner blade base 43. In this manner, the present embodiment adopts a configuration having no looseness.

Here, in the present embodiment, it is possible to carry out the assembly work, since a guide surface 59 in both ends of the inner blade base 43 causes the side edge 50 on both sides of the inner blade 42 to be pushed and expanded outward in the short direction (direction B) by the minute length, by only causing the inner blade base 43 to enter from below the inner blade 42. Therefore, it is unnecessary to perform a process for pushing and expanding the side edge 50 on both sides of the inner blade 42 outward in the short direction (direction B) by using a manufacturing device and a jig during the assembly work. Accordingly, the device costs can be decreased, and the production efficiency can be improved. In addition, since the assembly work can be carried out without using the manufacturing device and the jig, the width (width between the side edges 50) in the short direction (direction B) of the inner blade 42 can be formed to be narrower than that in the related art. Therefore, even when two or more sets (for example, five sets) of the blade units are provided, the reciprocating-type electric shaver can be formed to have a compact size by suppressing an increase in the thickness in the short direction.

Here, in the present embodiment, the attachment groove 52 is configured so that an opening edge portion (edge portion of an opening in the lower end) 52*a* is formed in a curved shape, that is, by means of curved surface processing (refer to FIGS. 4 and 6). Without being limited thereto, the opening edge portion 52*a* may be formed in an inclined shape, that is, may be configured by means of corner cutting (chamfering) processing. According to this configuration, an inclined surface 55*a* disposed in the distal end of the projection 55 comes into contact with the opening edge portion 52*a*, thereby inducing very smooth elastic deformation. Accordingly, the distal end (inclined surface 55*a*) of the projection 55 can enter the engagement groove 54 without being caught on the side edge 50 at all (refer to FIG. 7). In addition, processing for the opening edge portion 52*a* of the attachment groove 52 can be concurrently performed by press work or etching work when the small blade 46 is formed. Therefore, there are merits in that it is unnecessary to provide a special processing step.

According to the configuration disclosed as an example in PTL 2 in the related art, the lower end portion of the side edge is inevitably configured to have a sharp edge due to the processing step of the inner blade. Consequently, a malfunction occurs in which the lower end having the sharp edge is caught on the engagement projection, thereby causing a problem in that the assembly work between the inner blade and the inner blade base cannot be satisfactorily carried out. Even if processing for rounding the edge is performed by allowing an increase in the processes (that is, increase in the production costs and decrease in the production efficiency), the curved surface processing has some limits since a plate thickness of the side edge is very thin.

In contrast, according to the configuration of the attachment groove 52 and the projection 55 in the present embodiment, that is, according to the configuration in which the projection 55 can be elastically deformed in the in-plane direction on the wall surface of the side edge 50 (side wall 57) and in the longitudinal direction (direction A) of the inner blade 42 (inner blade base 43), and in which the engagement claw 56 disposed in the distal end of the projection 55 is formed so as to enter and engage with the engagement groove 54 disposed in the attachment groove 52 of the inner blade 42, the above-described problem can be solved. Furthermore, the configuration of the opening edge portion 52*a* of the attachment groove 52 fulfills the more useful function in solving the above-described problem.

That is, according to the present embodiment, it is possible to prevent a possibility that the assembly work cannot be carried out since a lower end portion of the inner blade 42 encroaches on the projection 55 of the inner blade base 43 during the assembly work. Therefore, the assembly work can be reliably carried out. As a result, it is possible to prevent a defective product and downtime in the production process.

In addition, as a characteristic configuration in the reciprocating-type electric shaver 1 according to the present embodiment, in the inner blade base 43, the right and left fixing ribs 58 are disposed at the position corresponding to the attachment grooves 52 of the inner blade 42. The right and left fixing ribs 58 are formed in a shape of being in close contact with an inner peripheral portion 52*c* which is opposite to an inner peripheral portion 52*b* which have the engagement groove 54 in the attachment groove 52 (refer to FIGS. 5 and 6).

Here, the right and left fixing ribs 58 are disposed at two locations in each of the two side walls 57. Peripheral walls 58*a* which come into close contact with the two inner peripheral portions 52*c* are formed to face outward mutually. According to this configuration, the two peripheral walls 58*a* come into close contact with the two inner peripheral portions 52*c* so as to face outward mutually. Therefore, it is possible to prevent a possibility that the inner blade 42 is misaligned with the inner blade base 43 in the longitudinal direction (direction A), thereby enabling mutual fixing work to be reliably carried out.

As a modification example, when the two engagement grooves 54 are formed to face outward mutually, a configuration may be adopted in which positions for coming into close contact with the two inner peripheral portions 52*c* are formed to face inward mutually. According to this configuration, similar to the above-described configuration, it is also possible to prevent the possibility that the inner blade is misaligned with the inner blade base 43 in the longitudinal direction (direction A), thereby enabling the mutual fixing work to be reliably carried out.

As described above, according to the reciprocating-type electric shaver 1, it is unnecessary to perform a folding process of the inner blade during the assembly work, and the inner blade can be therefore assembled to the inner blade base with a further decreased number of processes. Therefore, the production efficiency can be improved, and the production costs can be decreased.

In addition, it is possible to prevent a possibility that the assembly work cannot be carried out since the inner blade encroaches on the inner blade base during the assembly work. Therefore, the assembly work can be reliably carried out. As a result, it is possible to prevent a defective product and downtime in the production process.

Without being limited to the above-described embodiments, the present invention can be modified in various ways within the scope not departing from the spirit of the present invention. In particular, the reciprocating-type electric shaver having two sets of blade units has been described as an example. However, without being limited thereto, the present invention can also be preferably applied to a reciprocating-type electric shaver having three or more sets of blade units, for example.

What is claimed is:

1. A reciprocating-type electric shaver in which an inner blade supported by an inner blade base and having an inverted U-shape in a cross-sectional view slides and reciprocates on an inner surface of an outer blade, wherein the inner blade has a L-shaped attachment groove which is open downward in a lower end of a side edge, wherein an inner peripheral portion of the L-shaped attachment groove has an engagement groove which is recessed in an in-plane direction on a wall surface of the side edge and in a longitudinal direction of the inner blade, wherein the inner blade base has a L-shaped projection at a position corresponding to the L-shaped attachment groove of the inner blade, wherein the L-shaped projection can be elastically deformed in both the in-plane direction on the wall surface of the side edge and in the longitudinal direction of the inner blade, and is formed so that an engagement claw disposed in a distal end of the L-shaped projection can enter and engage with the engagement groove in the longitudinal direction and be in-plane with the side edge, and wherein the engagement claw engages with the engagement groove, thereby causing the inner blade to be fixed to the inner blade base.

2. The reciprocating-type electric shaver according to claim 1, wherein an opening edge portion of the attachment groove is formed in a curved shape or in an inclined shape.

3. The reciprocating-type electric shaver according to claim 1, wherein the inner blade base further has right and left fixing ribs at the position corresponding to the attachment groove of the inner blade, and wherein the right and left fixing ribs are formed in a shape of being in close contact with an inner peripheral portion which is opposite to an inner peripheral portion which have the engagement groove in the attachment groove.

4. The reciprocating-type electric shaver according to claim 2, wherein the inner blade base further has right and left fixing ribs at the position corresponding to the attachment groove of the inner blade, and wherein the right and left fixing ribs are formed in a shape of being in close contact with an inner peripheral portion which is opposite to an inner peripheral portion which have the engagement groove in the attachment groove.

5. The reciprocating-type electric shaver according to claim 1, wherein the attachment groove, the projection, and the right and left fixing ribs are respectively disposed at two locations in each of the two side edges, and wherein the two engagement grooves disposed in the two attachment grooves in one of the side edges are formed so as to face inward mutually or to face outward mutually.

6. The reciprocating-type electric shaver according to claim 2, wherein the attachment groove, the projection, and the right and left fixing ribs are respectively disposed at two locations in each of the two side edges, and wherein the two engagement grooves disposed in the two attachment grooves in one of the side edges are formed so as to face inward mutually or to face outward mutually.

7. The reciprocating-type electric shaver according to claim 3, wherein the attachment groove, the projection, and the right and left fixing ribs are respectively disposed at two locations in each of the two side edges, and wherein the two engagement grooves disposed in the two attachment grooves in one of the side edges are formed so as to face inward mutually or to face outward mutually.

8. The reciprocating-type electric shaver according to claim 4, wherein the attachment groove, the projection, and the right and left fixing ribs are respectively disposed at two locations in each of the two side edges, and wherein the two engagement grooves disposed in the two attachment grooves in one of the side edges are formed so as to face inward mutually or to face outward mutually.

9. The reciprocating-type electric shaver according to claim 1, wherein the projection is configured so that a lower end portion thereof is fixed to a side wall of the inner blade base, and is formed in a shape projecting upward.

10. The reciprocating-type electric shaver according to claim 2, wherein the projection is configured so that a lower end portion thereof is fixed to a side wall of the inner blade base, and is formed in a shape projecting upward.

11. The reciprocating-type electric shaver according to claim 3, wherein the projection is configured so that a lower end portion thereof is fixed to a side wall of the inner blade base, and is formed in a shape projecting upward.

12. The reciprocating-type electric shaver according to claim 4, wherein the projection is configured so that a lower end portion thereof is fixed to a side wall of the inner blade base, and is formed in a shape projecting upward.

13. The reciprocating-type electric shaver according to claim 5, wherein the projection is configured so that a lower end portion thereof is fixed to a side wall of the inner blade base, and is formed in a shape projecting upward.

14. The reciprocating-type electric shaver according to claim 6, wherein the projection is configured so that a lower end portion thereof is fixed to a side wall of the inner blade base, and is formed in a shape projecting upward.

15. The reciprocating-type electric shaver according to claim 7, wherein the projection is configured so that a lower end portion thereof is fixed to a side wall of the inner blade base, and is formed in a shape projecting upward.

16. The reciprocating-type electric shaver according to claim 8, wherein the projection is configured so that a lower end portion thereof is fixed to a side wall of the inner blade base, and is formed in a shape projecting upward.

* * * * *